US008052004B2

(12) United States Patent
Cheng et al.

(10) Patent No.: US 8,052,004 B2
(45) Date of Patent: Nov. 8, 2011

(54) RELEASABLE LOCKABLE LID

(75) Inventors: Benjamin Cheng, Palos Verdes Estates, CA (US); Chia-Ching Huang, Yongkang (TW)

(73) Assignee: Misaine Trade, Inc., Gardena, CA (US)

( * ) Notice: Subject to any disclaimer, the term of this patent is extended or adjusted under 35 U.S.C. 154(b) by 309 days.

(21) Appl. No.: 12/467,084

(22) Filed: May 15, 2009

(65) Prior Publication Data

US 2010/0288769 A1 Nov. 18, 2010

(51) Int. Cl.
*B65D 45/32* (2006.01)

(52) U.S. Cl. ..... 220/259.4; 220/319; 220/320; 220/315; 220/323; 215/275

(58) Field of Classification Search ..... 220/367.1, 220/713, 259.4, 319, 784, 320, 323, 315; 215/273–276

See application file for complete search history.

(56) References Cited

U.S. PATENT DOCUMENTS

| | | | | |
|---|---|---|---|---|
| 34,976 | A | 4/1862 | Nicholson | |
| 848,174 | A | 3/1907 | Jebsen | |
| 1,341,177 | A | 5/1920 | Kaye | |
| 2,587,737 | A | 3/1952 | Koster | |
| 2,587,738 | A | 3/1952 | Koster | |
| 4,410,102 | A | 10/1983 | Lutzker | |
| 4,625,890 | A * | 12/1986 | Galer | 220/784 |
| 6,158,604 | A | 12/2000 | Larguia, Sr. et al. | |
| 6,374,726 | B1 * | 4/2002 | Melton | 220/718 |
| 2001/0010311 | A1 * | 8/2001 | Ciccone | 220/784 |
| 2007/0175853 | A1 | 8/2007 | Kebben | |
| 2008/0190930 | A1 * | 8/2008 | Vogel et al. | 220/276 |

FOREIGN PATENT DOCUMENTS

| | | | |
|---|---|---|---|
| AU | 488194 | B2 | 10/1977 |
| DE | 2721387 | A1 | 11/1978 |
| FR | 2907765 | A1 | 5/2008 |
| GB | 2 272 210 | A | 5/1994 |
| WO | WO 03/037738 | A | 5/2003 |

OTHER PUBLICATIONS

International Search Report and Written Opinion dated Feb. 12, 2010, for PCT/US2009/045981, filed Jun. 2, 2009.

* cited by examiner

*Primary Examiner* — J. Gregory Pickett
*Assistant Examiner* — Andrew Perreault
(74) *Attorney, Agent, or Firm* — Knobbe, Martens, Olson & Bear LLP

(57) ABSTRACT

A releasably locking lid for a beverage container is disclosed. More specifically, lid embodiments include an outer surface, an inner surface, and a lip, the lid including a center piece and an outer ring that is configured to rotate relative to the center piece to releasably lock the container within a receiving space in the lid.

22 Claims, 5 Drawing Sheets

RELEASABLE LOCKABLE LID

BACKGROUND

1. Field

The inventive field relates generally to a lid for a beverage container. More particularly, it relates generally to lids that may be releasably secured or locked to a beverage container.

2. Description of the Related Technology

Many variations of beverage container lids have been introduced in recent years. The containers have been made from various materials such as stainless steel, polymer, glass, and ceramic. Beverage containers have often been designed to keep the liquids inside either hot or cold. Some of these beverage containers are designed to mate with lids to prevent spills and to further enhance the temperature maintenance of the contained beverages.

SUMMARY OF CERTAIN INVENTIVE ASPECTS

One inventive aspect is a lid for a container including an inner surface, an outer surface, and a lip, the lid including a center piece including a first retention surface extending generally in a first direction, the first retention surface having a first diameter, and one or more second retention surfaces extending generally in the first direction, wherein the one or more second retention surfaces are distanced from the first retention surface so as to define a receiving space therebetween, wherein the receiving space has a width that is sized so as to releasably accept at least a portion of the container, and wherein the one or more second retention surfaces are disposed outside the first retention surface. The lid also including an outer ring that is configured to move relative to the center piece between at least a first position and a second position, the outer ring having a second diameter that is greater than the first diameter, and wherein the outer ring comprises one or more flanges, wherein the one or more flanges extend generally towards the first retention surface, and wherein the flanges have a first end and second end, wherein the first end of each flange extends towards the first retention surface to a greater degree than the second end of each flange.

In another aspect, the center piece may include a plurality of second retention surfaces situated in a generally curvilinear shape having a third diameter, wherein the third diameter is greater than the first diameter, and wherein the third diameter is less than the second diameter. In an aspect, when the outer ring is in the second position, the width of the receiving space is less than the width of the receiving space when the outer ring is in the first position. In an aspect, the width of the receiving space decreases as the outer ring moves from the first position to the second position. In another aspect, the second retention surface includes a plurality of second retention surfaces, and the second retention surfaces are substantially evenly spaced from one another. In an aspect, the center piece may include a first aperture and/or second aperture. In an aspect, the center piece also includes a cover configured to move between an open position and a closed position, wherein the cover substantially covers the first aperture when it is in the closed position and the cover does not substantially cover the first aperture when it is in the open position. In one aspect, the outer ring comprises a plurality of flanges and the flanges are substantially evenly spaced from one another. In an aspect, the number of second retention surfaces is equal to the number of flanges. In another aspect, the one or more second retention surfaces include one or more downward extending tabs and the lid may include an O-ring disposed at least partially on the first retention surface.

Another inventive aspect is a lid for a beverage container including an inner surface an outer surface and a rim, the lid including a center piece including a first retention surface extending generally in a first direction, the first retention surface having a first diameter and one or more second retention surfaces extending generally in the first direction, wherein the one or more second retention surfaces are positioned relative to the first retention surface so as to define a receiving space therebetween, and wherein the one or more second retention surfaces are disposed outside the first retention surface. The lid also includes an outer ring that is configured to move relative to the center piece between at least a first position and a second position, the outer ring having a second diameter that is greater than the first diameter, and wherein the outer ring comprises one or more flanges, wherein the one or more flanges extend generally towards the first retention surface, and wherein the flanges have a first end and a second end, wherein the first end of each flange extends towards the first retention surface to a greater degree than the second end of each flange, and wherein the one or more flanges are configured to slidably engage with the one or more second retention surfaces.

In an aspect, in the first position at least a portion of the one or more second retention surfaces are not engaged with at least a portion of the one or more flanges. In another aspect in the first position at least a portion of the one or more second retention surfaces are engaged with at least a portion of the one or more flanges. In an aspect, in the second position at least a portion of the one or more second retention surfaces are engaged with at least a portion of the one or more flanges. In another aspect, in the second position, the width of the receiving space is less than when the outer ring is in the first position. In an aspect, in the second position, at least a portion of at least one second retention surface is engaged with at least a portion of the first end of one or more flanges. In another aspect, in the first position, at least a portion of one second retention surface overlaps at least a portion of the second end of one or more flanges. In aspect, in the first position, at least a portion of at least one second retention surface does not overlap at least a portion of one or more flanges. In another aspect, the one or more second retention surfaces comprise a groove configured to slidably engage at least a portion of a flange. In an aspect, as the outer ring is moved between the first position and the second position, at least a portion of at least one second retention surface engages at least a portion of a flange, and the second retention surface is moved towards the inner ring. In an aspect, when the outer ring is in the second position, at least a portion of at least one second retention surface overlaps at least a portion of a flange.

Another inventive aspect is a lid and container kit including a container including an inner surface and a lid for the container. The lid for the container includes a center piece including a first retention surface extending generally in a first direction, the first retention surface having a first diameter, wherein the first retention surface is configured to contact at least a portion of the inner surface, one or more second retention surfaces extending generally in the first direction, wherein the one or more second retention surfaces are distanced from the first retention surface so as to define a receiving space therebetween, wherein the receiving space has a width that is sized so as to releasably accept at least a portion of the rim, wherein the one or more second retention surfaces are disposed outside the first retention surface and wherein the one or more second retention surfaces are configured to contact at least a portion of the outer surface, and an outer ring that is configured to move relative to the center piece between at least a first position and a second position, the outer ring having a second diameter that is greater than the first diameter, and wherein the outer ring comprises one or more flanges, wherein the one or more flanges extend generally towards the first retention surface, and wherein the flanges have a first end and second end, wherein the first end of each flange extends towards the first retention surface to a greater degree than the second end of each flange.

Another inventive aspect is a lid for a container including an inner surface, an outer surface, and a lip, the lip including first means for frictionally gripping the inner surface, second means for frictionally gripping the outer surface with an opposing force to the first means, and means for deflecting the second means towards the first means so as to reduce the distance in the receiving space formed between the first means and the second means, wherein the receiving space is configured to accept at least a portion of the lip of the container.

DETAILED DESCRIPTION

Embodiments of the lid are described herein with reference to the attached drawings. The drawings are merely illustrative, and in no way limit the claims to what is shown.

Figure 1:
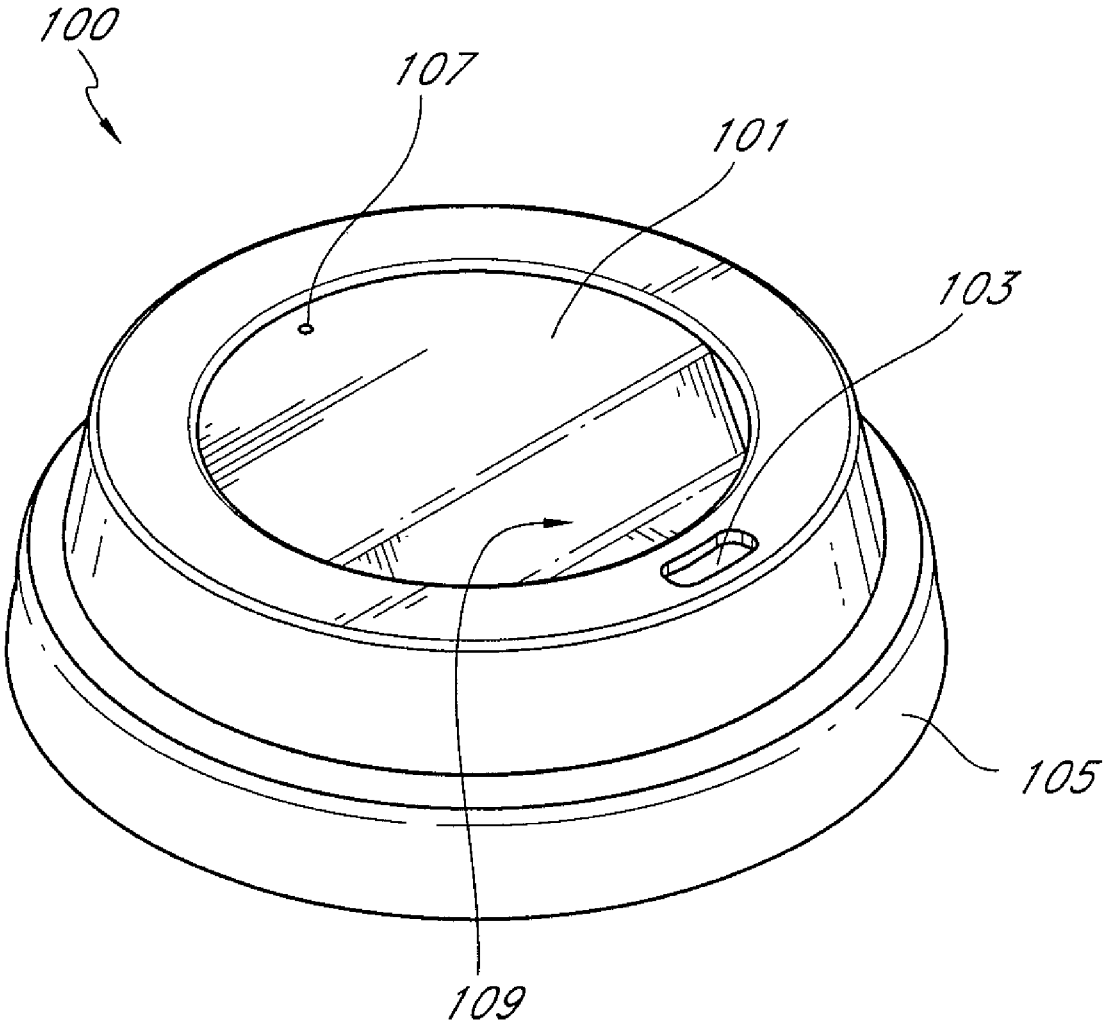
FIG. 1 is a top perspective view of an embodiment of a lid for a container.

Referring to the Figures, FIG. 1 schematically depicts a lid 100 that can be releasably locked to a container, according to one embodiment. The lid 100 can allow a container to be transported without spilling the contents of the container. Securing the lid 100 to a container generally assists in regulating the temperature of a beverage inside the container. For example, the lid 100 may be locked to a container holding a hot liquid in order to inhibit or slow heat transfer from the contained liquid to the ambient environment. In an embodiment, the lid 100 may be coupled to a container holding a cold liquid and may be configured to inhibit heat transfer from the ambient environment to the liquid inside the container. The lid 100 may also prevent contaminants from entering the container. For example, the lid 100 may prevent dirt, dust, and/or insects from contacting a liquid (such as a beverage) contained within the container.

The lid 100 includes a generally dome shaped center piece 101 and an outer ring 105. In some embodiments, the center piece 101 may taper from bottom to top along one or more edges or sides. In some embodiments, the center piece 101 may be curvilinear. For example, the center piece 101 may be generally circular. In other embodiments, the center piece 101 may be in the shape of a polygon. For example, the center piece 101 may be shaped generally like a hexagon. In some embodiments, the outer ring 105 may be curvilinear. For example, the outer ring 105 may be generally circular. In another embodiment, the outer ring 105 may be generally in the shape of a polygon. For example, the outer ring 105 may be generally octagonal. In some embodiments, the outer ring may taper from bottom to top along one or more edges or sides. In an embodiment, the outer ring 105 and the center piece 101 can be shaped similarly. For example, the outer ring 105 and the center piece 101 may both be generally circular. In another embodiment, the outer ring 105 and the center piece 101 may be shaped differently. For example, the outer ring 105 may be generally in the shape of a polygon and the center piece 101 may be generally in the shape of a polygon.

The lid 100 and its components may be made of various materials. Examples of suitable materials include, but are not limited to polymers, rubbers, carbon fiber, composite materials (e.g., glass-reinforced plastic or fiber-reinforced polymers), metals, glass, ceramics, and organic materials (e.g., wood, engineered wood, plywood, or balsa wood). Suitable polymers include, but are not limited to, polycarbonate, polyethylene, polyethylene terephthalate, polypropylene, polystyrene, polyvinyl chloride and mixtures thereof. In some embodiments, the center piece 101 and the outer ring 105 may be made of similar materials. For example, in an embodiment, the center piece 101 and the outer ring 105 may be each made of a polymer. As used herein, the term polymer refers to homopolymers, copolymers, and mixtures thereof. The polymer used to fabricate the center piece 101 can be the same as the outer ring 105. Alternatively, the polymer used for the center piece 101 can be different from the polymer used for the outer ring 311. In other embodiments, the center piece 101 and the outer ring 105 may be made of different materials. For example, the center piece 101 may be made of a ceramic and the outer ring 105 may be made of a metal. In another embodiment, the center piece 101 and the outer ring 105 can each be made of different polymers. In an embodiment, the materials for the lid 100 are chosen based off of their heat transfer properties. For example, copper may be chosen as a material for the center piece 101 and/or the outer ring 105 to promote heat transfer through the lid 100. In an embodiment, a polymer may be used for the center piece 101 and/or outer ring 311 to inhibit heat transfer through the lid 100. The materials for the lid 100 may also be chosen based off of other characteristics or properties. For example, the materials for the lid 100 may be chosen based off of hardness, durability, rigidity, and/or conductivity characteristics.

Still referring to FIG. 1, in some embodiments, the center piece 101 may optionally include a dispensing aperture 103 and/or a ventilation aperture 107. The dispensing aperture 103 and the ventilation aperture 107 may be any shape. For example, the apertures 103, 107 may be in the shape of a circle, oval, curvilinear shape, square, slit, slot, rectangle, triangle, hexagon, octagon, polygon, or any other shape. In an embodiment, the dispensing aperture 103 may be about the same general shape as the shape of the ventilation aperture 107. For example, the dispensing aperture 103 and ventilation aperture 107 may both be generally in the shape of a circle. In another embodiment, the dispensing aperture 103 may be shaped differently than the ventilation aperture 107. For example, the dispensing aperture 103 may be generally triangular and the ventilation aperture 107 may be generally curvilinear.

In some embodiments, the dispensing aperture 103 and the ventilation aperture 107 may be configured to allow the ingress and egress of matter therethrough. For example, in an embodiment, the dispensing aperture 103 may be configured to allow a user to sip liquid through the lid 100. In an embodiment, the dispensing aperture 103 may be configured to receive a portion of a straw. In another embodiment, the dispensing aperture 103 may be configured to allow a user to pour liquid or fine solid matter through the dispensing aperture 103. Additionally, in some embodiments, the ventilation aperture 107 may be configured to allow vapor and/or gas to pass through the ventilation aperture 107 in order to regulate the temperature of a liquid or substance contained underneath the lid 100. For example, in an embodiment, the ventilation aperture 107 may be sized to gradually cool a body of hot liquid confined underneath the lid 100 by allowing vapor and/or gas to pass through the ventilation aperture 107.

The size of the dispensing aperture 103 and the size of the ventilation aperture 107 can vary. In an embodiment, the dispensing aperture 103 and the ventilation aperture 107 may be similarly sized. In another embodiment, the dispensing aperture 103 and the ventilation aperture 107 may be differently sized. In an embodiment, the ventilation aperture 107 can be smaller in size relative to the size of the dispensing aperture 103. In some embodiments, the dispensing aperture 103 may be in the range of about 0.125 and about 0.250 square inches and the ventilation aperture 107 may be in the range of about 0.050 and about 0.010 square inches. In other embodiments, the dispensing aperture 103 may be in the range of about 0.100 and about 1.00 square inches and the ventilation aperture 107 may be in the range of about 0.050 and about 1.00 square inches. The apertures 103, 107 may be positioned in various locations on the center piece 101. For example, in an embodiment, apertures 103, 107 may be positioned near the center of the center piece 101. In another embodiment, apertures 103, 107 may be positioned near the edge of the center piece 101. In another embodiment, the apertures 103, 107 may be positioned on approximately opposite sides of the center piece 101.

The lid 100 may include additional apertures (not shown) as needed to further regulate the temperature of a substance or matter contained underneath the lid and/or to allow access through the lid 100. In some embodiments, the center piece 101 may include a mechanism or mechanisms (not shown) configured to open and/or close any apertures, including the dispensing aperture 103 and the ventilation aperture 107. There are various mechanisms known to those skilled in the art that may be utilized to open and/or close any apertures contained on the center piece 101. A non-limiting list of examples includes a sliding cover, a hinged cover, a plug, a cap, a toggle, a rotating cover, a snapping cover, a zipper, a stopper, a casing, a fill, a choke, and/or a cork. In an embodiment, a sliding cover can be configured to open and close the ventilation aperture 107 and a hinged cover is used to open and close the dispensing aperture 103. In another embodiment, the lid 100 can include a sliding cover configured to open and close the dispensing aperture 103 and/or the ventilation aperture 107. In another embodiment, the lid 100 can include a hinged cover configured to open and close the dispensing aperture 103 and/or the ventilation aperture 107.

In another embodiment, the lid 100 can include a mechanism (for example, a hinge, sliding cover, or toggle) to open and close the dispensing aperture 103 which does not open and close the ventilation aperture 107. In another embodiment, the lid 100 can include a single mechanism to open and close both the dispensing aperture 103 and the ventilation aperture 107. The opening and closing mechanism may aid in making the lid 100 more suitable for carrying around a liquid in the container and help prevent the spillage of matter contained inside the container. For example, the opening and closing mechanism may prevent a user from spilling a hot liquid on their person and/or others.

The center piece 101 may also include one or more depressions. In some embodiments, the one or more depressions 109 may span the width of the center piece 101 or may span a shorter distance. For example, in an embodiment, the depression 109 may span from one edge of the center piece 101 to another edge of the center piece. In an embodiment, the depression may be positioned in the center of the center piece 101. In some embodiments, the depression 109 may be configured to allow a user to easily grip the center piece 101 with their mouth. For example, the depression 109 may be configured to accept or receive at least a portion of a user's upper lip. In some embodiments, the depression 109 may be configured to accept or receive at least a portion of a closing mechanism. For example, a center piece 101 may include a first depression 109 configured to receive a portion of a toggle when the toggle is in the closed position and a second depression configured to receive a portion of the toggle when the toggle is in the open position. In another embodiment, a center piece 101 may include a single depression 109 configured to accept a toggle in an open position and closed position. The depth of the depression 109 may vary depending on the size of the object intended to be received by the depression. For example, in an embodiment, the depth of the depression 109 may be configured to receive at least a portion of an upper lip of an adult human. In another embodiment, the depth of the depression 109 may be configured to receive at least a portion of an upper lip of an infant human. In some embodiments, the depth of one or more depressions 109 may be configured to receive at least a portion of a hinged cover. In some embodiments, the center piece 101 may also include one or more channels, grooves, or recesses (not shown) configured to provide a user access to a depression 109. In an embodiment, a center piece 101 may include a recess along one or more edges to provide a user access to a portion of a hinged or sliding cover, where the cover may be at least partially within a depression 109.

Figure 2:
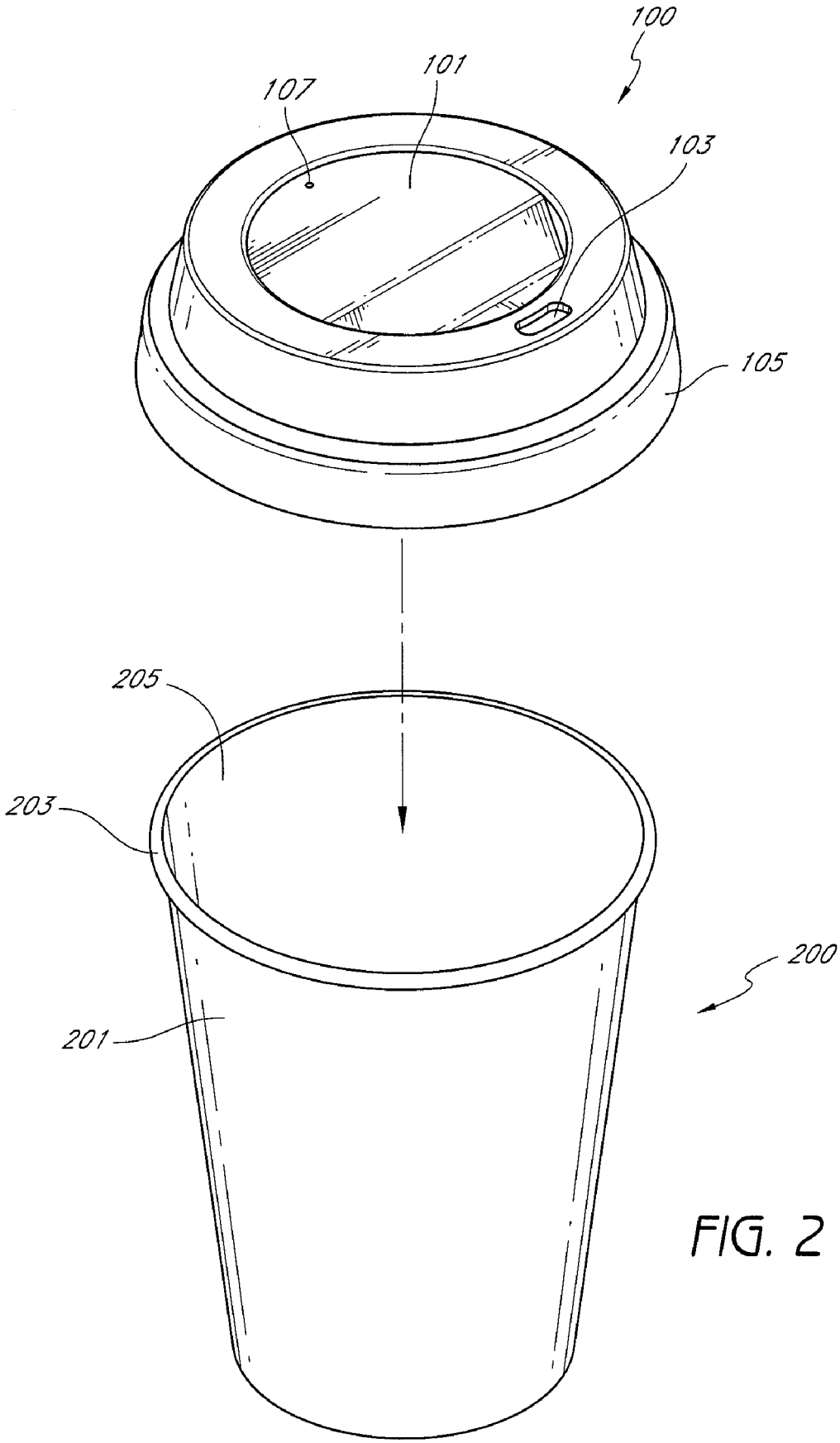
FIG. 2 is a top perspective view of the lid shown in FIG. 1 and a container.

The lid 100 may be releasably secured, coupled, and/or locked to various containers (for example, the container shown in FIG. 2). The container may be a beverage container, a liquid container, a fine solid matter container, a glass, a cup, a mug, a food storage container, a general storage container, a jar, a ramekin, a bowl, a stein, a tankard, a highball, a tumbler, a wine glass, a flute, a tube, a kettle, a canteen, a water cooler, drinkware, a bottle, a jug, a demitasse, a pan, a pot, a condiment dispenser, a soap dispenser, a spice holder, a double-walled cup, a pet bowl, a baby bottle, a bottle of spirits, a disposable cup, a bucket, a trough, a biodegradable cup, a reusable cup, a double-walled container, a double-walled ceramic cup, or any other container. The container may be made of one or more various materials. Suitable materials include, but are not limited to, biodegradable material, paper, ceramic, polymer, metal, carbon fiber, composite material, rubber, organic material, and/or glass. In some embodiments, the container may be formed of the same material as the lid 100. For example, the container may be made primarily of a polymer and the lid 100 may be made primarily of a polymer. The polymers of the lid 100 and the container can be the same or different. In another embodiment, the container and the lid 100 may be formed of different material(s). For example, the container may comprise a ceramic and the lid 100 may comprise one or more polymers. As used herein, when referring to container 200, the container can be any suitable container and not only the container shown in FIG. 2 unless otherwise indicated.

The size of the container 200 may vary. For example, in an embodiment, the container 200 may be sized to hold about 2 cups of liquid. In another embodiment, the container 200 may be sized to hold about 4 cups of liquid. In some embodiments, the container 200 may include an inner surface 205, an outer surface 201, and a lip, edge, and/or rim 203. In an embodiment, at least a portion of the top of the inner layer 205 may extend beyond the upper edge of the outer layers 201. In another embodiment, at least a portion of the top of the inner layer 205 extending beyond the upper edge of the outer layer 201 may be configured to engage the upper edge of the outer layer 201. The lip 203 may comprise portions of the inner layer 205 and outer layer 203. For example, the juncture of the outer layer 201 and the inner layer 205 may form a midline of the lip 203. In another embodiment, the lip may be disposed at least partially between the inner layer 205 and the outer layer 201.

The shape of the container 200 may vary. For example, in an embodiment, the lip 203 of the container 200 may be curvilinear. In another embodiment, the lip 203 may be polygonal. For example, the lip 203 may be generally hexagonal. The thickness of the container between the outer surface 201 and the inner surface 205 may vary. For example, in an embodiment, the container 200 may be shaped to minimize heat transfer between the inner surface 205 and the outer surface 201. In another embodiment, the distance or thickness between the inner surface 205 and the outer surface 201 may be minimized to increase heat transfer between the two surfaces. In some embodiments, the container 200 may be a cup or mug, for example, a double-walled ceramic mug. In other embodiments, the container 200 may be a plastic cup (e.g. a double-walled cup). In an embodiment, the container 200 may be configured to hold a hot liquid, for example, tea, cocoa, water, milk, formula, coffee, wassail, or cider.

The container 200 and the lid 100 may have various color schemes or designs. In an embodiment, the container 200 and the lid 100 may be similarly colored, for example white. In another embodiment, the container 200 and the lid 100 may be differently colored. For example, the container 200 may be white or light colored and the lid 100 may be black or dark colored. In an embodiment, the container 200 and the lid 100 may also contain designs or illustrations. For example, the container 200 may contain a logo or design for a company or restaurant and the lid 100 may be uniformly colored. In an embodiment, the lid 100 and/or the container 200 may contain information on where to purchase the lid or container and/or instructions for how to use the lid and container.

Figure 3:
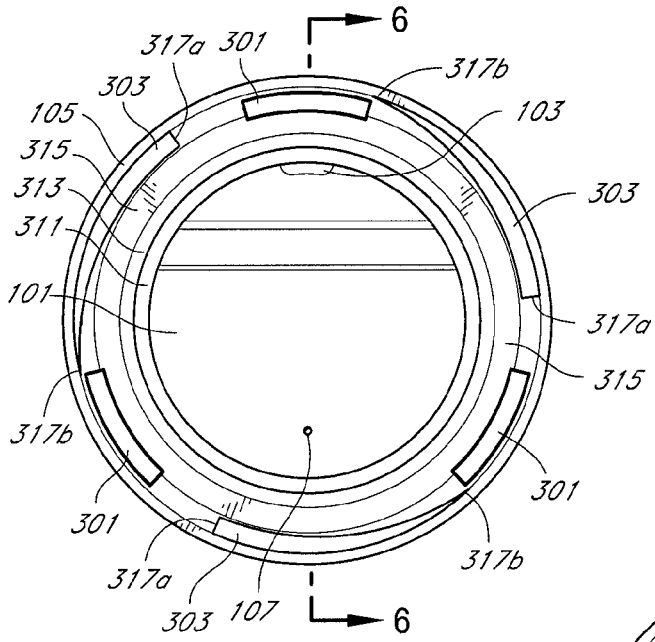
FIGS. 3-5 are bottom plan views schematically depicting the lid shown in FIG. 1.
Figure 4:
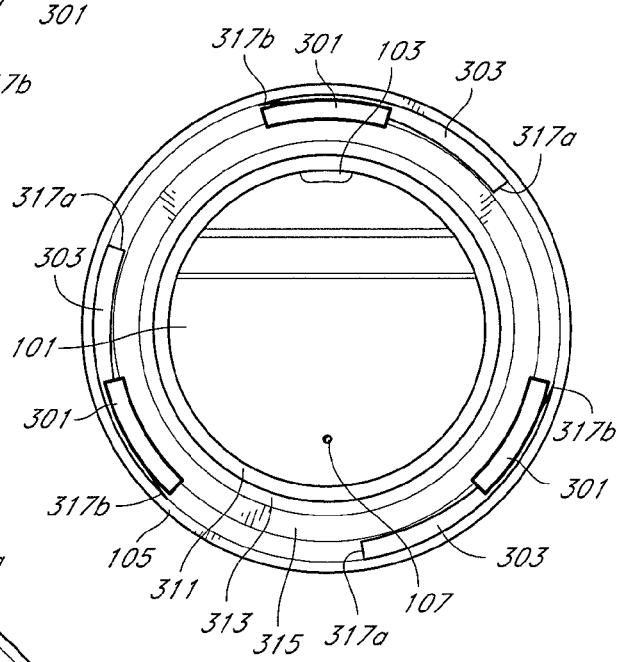
Figure 5:
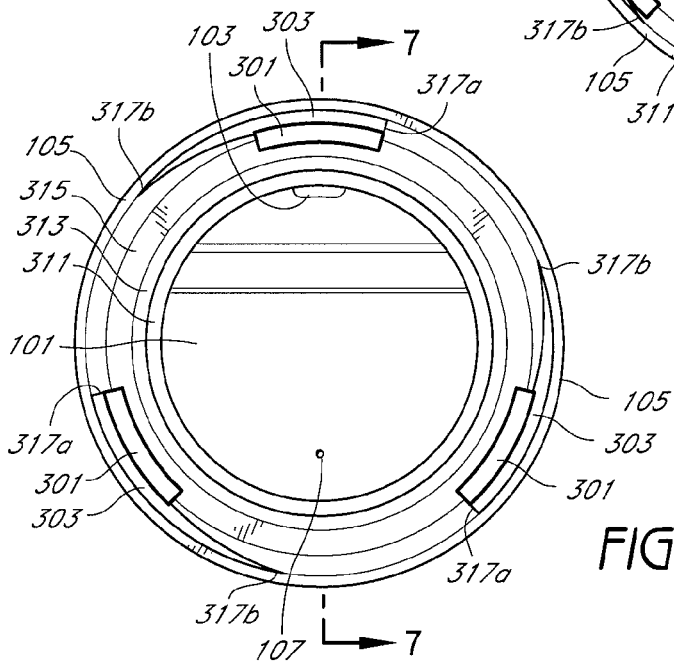

Turning now to FIGS. 3-5, bottom views schematically depicting the lid shown in FIGS. 1 and 2 are shown. Referring to FIG. 3, in some embodiments, the outer ring 105 may include one or more flanges 303. In some embodiments, the flanges can be in the form of protrusions and/or extensions. In some embodiments, the flanges 303 can extend from the outer ring 105 towards the inner ring 311. In an embodiment, the flanges 303 may extend from an inner surface of the outer ring 105 towards the inner ring 311. Each flange 303 can include at least a first side 317*a* and a second side 317*b* with the first side 317*a* extending towards the inner ring 311 to a greater degree than the second side 317*b*. As a result of the first side 317*a* extending towards the inner ring 311 to a greater degree than the second side 317*b*, a flange 303 has an edge that slopes gradually inward from the second side 317*b* to the first side 317*a*. Stated differently, the flange 303 can continuously extend inwards to a greater degree from the second side 317*b* to the first side 317*a*. In an embodiment, the flanges 303 may be tapered along one or more sides or edges (for example, the edge between the first side 317*a* to the second side 317*b*).

The flanges 303 may comprise the same material(s) as the outer ring. For example, the flanges 303 may comprise, but are not limited to, polymer, rubber, carbon fiber, composite material, metal, glass, ceramic, organic material, and/or other suitable materials. In an embodiment, the flanges comprise a polymer. The number of flanges 303 may vary. For example, in some embodiments, the outer ring 105 may include one or more flanges. In other embodiments, two or more flanges may be present. In an embodiment, the outer ring 105 may include 3 or more flanges 303. In another embodiment, the outer ring 105 may include 4 or more flanges 303. The flanges 303 may be evenly spaced from one another or they may be unevenly spaced from one another. For example, in an embodiment, the outer ring 105 may include 3 flanges that are evenly spaced relative to one another. In some embodiments, the first sides 317*a* of each flange may extend toward the inner ring 311 to approximately the same degree. For example, in an embodiment, the first sides 317*a* of each flange 303 extend about 0.050 inches towards the inner ring. In another embodiment, the first side 317*a* of each flange 303 extends towards the inner ring 311 to a different degree than the other first sides 317*a*.

Still referring to FIGS. 3-5, in some embodiments, the center piece 101 may include an inner ring 311, an optional O-ring 313, and one or more second retention surfaces or tabs 301. The second retention surfaces 301 can be various forms. Examples of suitable forms of the second retention surfaces 301 include, but are not limited to, tabs, flaps, protrusions, extensions, or fingers.

The number of second retention surfaces 301 may vary. In an embodiment, the center piece 101 may include more than one second retention surface 103. In another embodiment, the center piece 101 may include two or more second retention surfaces 301. In another embodiment, the center piece 101 may include three or more second retention surfaces 301. In another embodiment, the center piece 101 may include more than four second retention surfaces 301. In some embodiments, the number of flanges 303 may equal the number of second retention surfaces 301. In another embodiment, the number of flanges 303 may not equal the number of second retention surfaces 301. For example, in an embodiment, there may be two flanges 303 and four second retention surfaces 301. In another embodiment, there may be three flanges 303 and three second retention surfaces 301.

When there is more than one second retention surface 301, the position of the second retention surfaces relative to each other may vary. In an embodiment, the second retention surfaces may be evenly spaced from one another. For example, in an embodiment, the center piece 101 may include three second retention surfaces evenly spaced from one another. In another embodiment, the second retention surfaces 301 may be unevenly spaced from one another. For example, the center piece 101 may include three second retention surfaces with a first second retention surface 301 being positioned closer to a second retention surface 301 than a third second retention surface 301.

The inner ring 311 and the second retention surfaces 301 may be made of similar materials. For example, in an embodiment, the inner ring 311 may be made of a polymer and the second retention surfaces 301 may be made of a polymer. The polymers in the inner ring 311 and the second retention surfaces 301 may be the same or different. In another embodiment, the inner ring 311 and the second retention surfaces 301 may be made of different materials. For example, the inner ring may be made of metal and the second retention surfaces 301 may be made of a polymer. In some embodiments, the second retention surfaces 301 can extend generally from an outer edge of the center piece 101 and the inner ring 311 can extend from an inner portion of the center piece 101. In an embodiment, the second retention surfaces 301 may be situated in a curvilinear shape with a center and a first diameter and the inner ring 311 may share about the same center and have a second diameter that is less than the first diameter. In some embodiments, the second retention surfaces 301 and the inner ring 311 may extend from the center piece 101 such that the inner ring 311 is disposed nearer to the center of the center piece than the second retention surfaces. In an embodiment, the second retention surfaces 301 and the inner ring 311 may be positioned such that the inner ring is disposed between the center of the center piece 101 and the second retention surfaces 301. In some embodiments, the inner ring 311 and the second retention surfaces 301 extend generally in about the same direction (for example, generally downward) and are positioned relative to each other so as to form a receiving space 315, such as a channel or gap, therebetween. In some embodiments, the second retention surfaces 301 may be approximately evenly spaced from the inner ring 311. For example, the second retention surfaces 301 may each be spaced about 0.500 inches from the inner ring 311 to form a uniform receiving space 315 therebetween. In another embodiment, the second retention surfaces 301 may be unevenly spaced from the inner ring 311.

The inner ring 311 and the second retention surfaces 301 may extend about the same distance or different distances in a first direction. For example, in an embodiment, the inner ring 311 may extend downward about 0.500 inches and the second retention surfaces 301 may each extend downward about 0.400 inches. In another embodiment, the second retention surfaces 301 may extend in a first direction about 0.500 inches and the inner ring 311 may extend in the first direction about 0.500 inches. In some embodiments, the second retention surfaces 301 may each extend different distances. For example, in an embodiment with two second retention surfaces 301, a first second retention surface 301 may extend about 0.300 inches and a second retention surface 301 may extend about 0.600 inches. The thicknesses of the inner ring 311 and the second retention surfaces 301 may vary. Additionally, the thicknesses of the inner ring 311 and the second retention surfaces 301 may be similar or different. For example, in an embodiment, the second retention surfaces 301 may each be about 0.050 inches thick and the inner ring 311 may be about 0.100 inches thick. In another embodiment with two second retention surfaces 301, a first second retention surface 301 may be about 0.050 inches thick, a second retention surface 301 may be about 0.100 inches thick and the inner ring 311 may be about 0.150 inches thick. In some embodiments, the inner ring 311 may be thicker than one or more of the second retention surfaces 301.

In some embodiments, the receiving space 315 may be configured to receive at least a portion of a container, such as a beverage container. For example, in an embodiment, the receiving space 315 may be configured to receive at least a portion of a lip or rim of a container. The width and depth of the receiving space 315 may vary depending on the size of the portion of the container to be received. When a portion of a container is received by the receiving space 315, the inner ring 311 may form a first retention surface and the second retention surfaces 301 may each form second retention surfaces. The first retention surface may be configured to frictionally grip a portion of a surface of a received container and the second retention surfaces may be configured to frictionally grip a portion of another surface of a received container. In an embodiment, the receiving space 315 may receive a portion of a container and the inner ring 311 may contact or engage an inner surface of the container and the second retention surfaces 301 may contact or engage an outer surface of the container to frictionally grip the container within the receiving space 315. As an example, in an embodiment, the first retention surface can be configured to frictionally grip or engage a portion of the inner surface of a container and the second retention surfaces can be configured to frictionally grip, grasp, or constrain a portion of the outer surface of the coffee cup.

Figure 6:
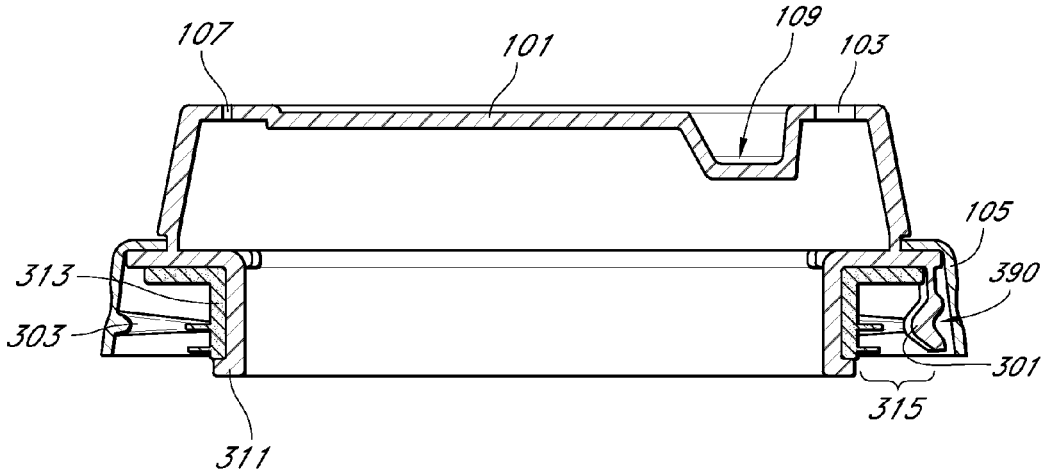
FIG. 6 is a cross-sectional view of the lid shown in FIG. 3 taken along line 6-6.

As shown in FIGS. 3-7, in an embodiment, the center piece 101 and the outer ring 105 are configured to move relative to each other. In some embodiments, the outer ring 105 can be configured to rotate relative to the center piece 101. Additionally, the outer ring 105 and the center piece can be configured to move from a first position to a second position. When the outer ring 105 is in a first position, in some embodiments, one or more of the flanges 303 are not in contact with the second retention surfaces 301, as shown in FIGS. 3 and 6. In other embodiments, when the lid 100 is in the first position, one or more of the flanges 303 may be in contact with a portion of one or more of the second retention surfaces 301. In some embodiments, when the lid 100 is in the first position, one or more of the second retention surfaces 301 may overlap a portion of a flange 303. In other embodiments, when the lid 100 is in the first position, one or more of the second retention surfaces 301 do not overlap a portion of a flange 303. In the instance where there is overlap between a portion of the second retention surface 301 and the flange 303, the second retention surface 301 and the flange 303 may or may not contact each other.

Figure 7:
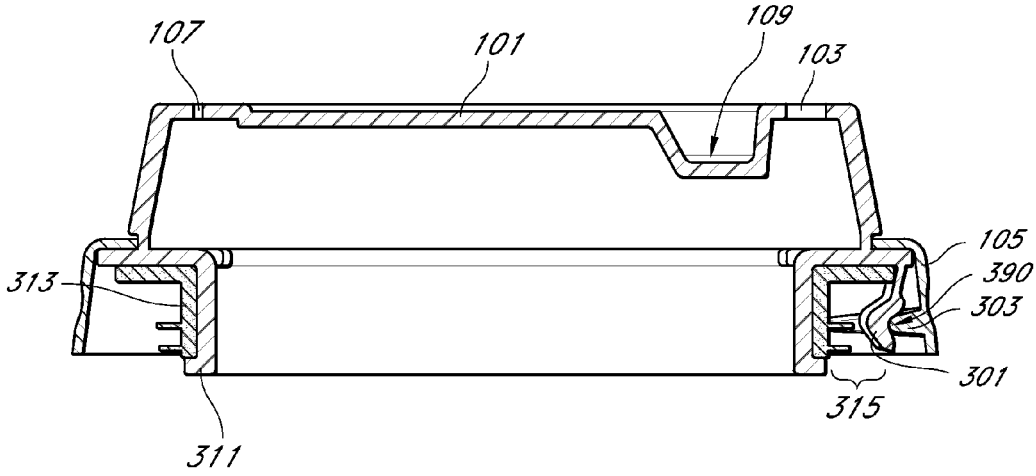
FIG. 7 is a cross-sectional view of the lid shown in FIG. 5 along line 7-7.
Figure 8:
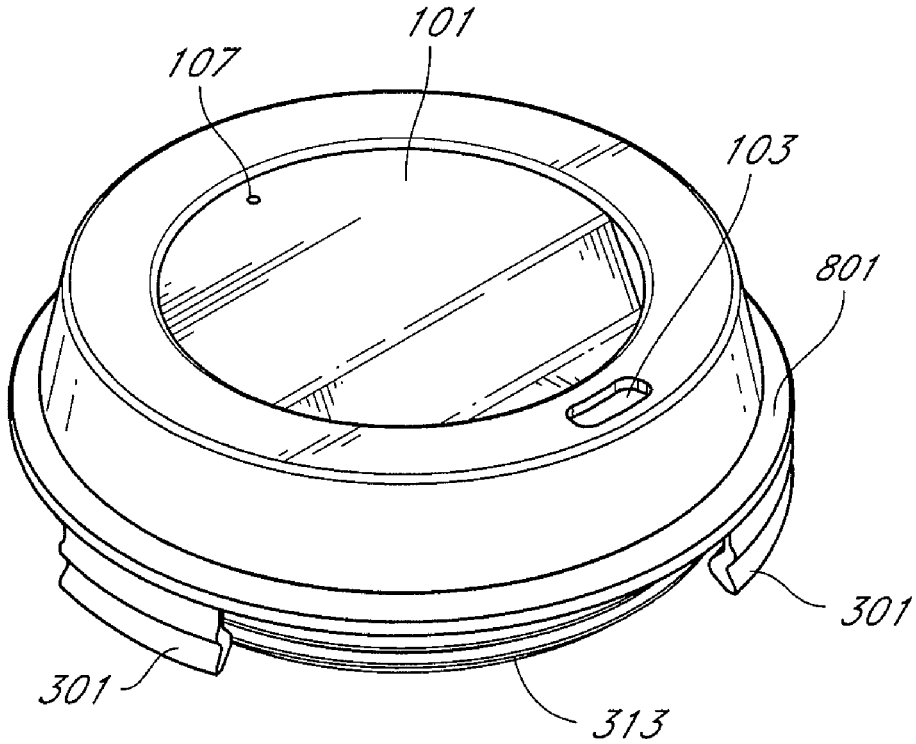
FIG. 8 is an exploded view showing the lid depicted in FIG. 1.
Figure 8:
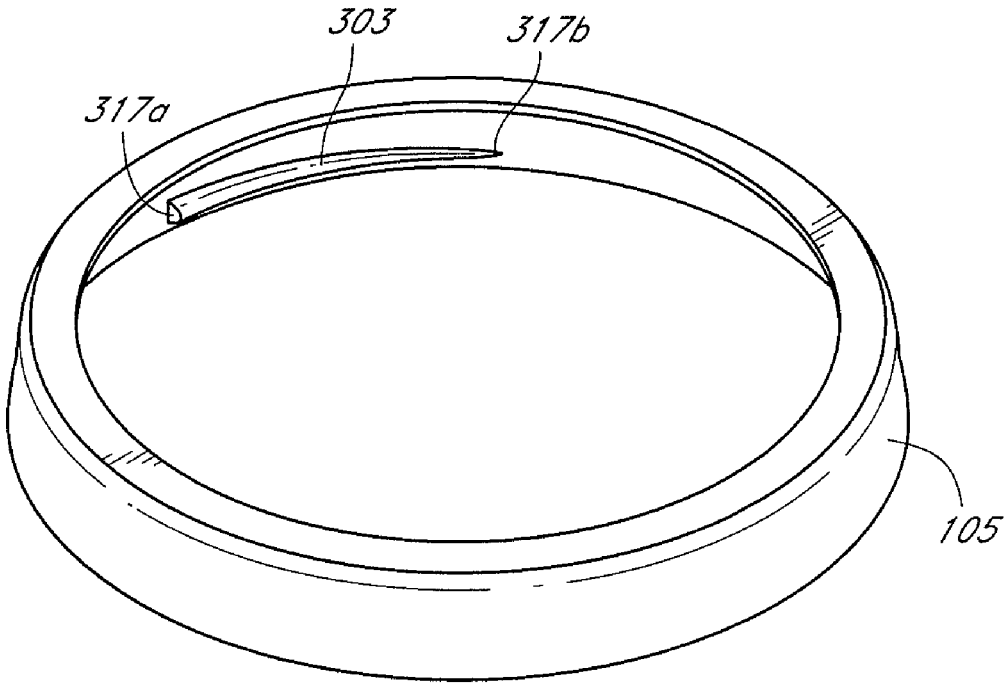

The second retention surfaces 301 may be configured to deflect, move, sway, curve, bow, flex, curve, yaw, twist, divert, pivot, or bend towards or away from the inner ring 311. For example, the second retention surfaces 301 may be configured to bend towards the inner ring 311 when a force pushes on the second retention surfaces 301. As shown in FIG. 8, second retention surfaces 301 may include a curvilinear shape. For example, the second retention surfaces 301 may include a hook shape. In another embodiment, the second retention surfaces 301 may include a polygonal shape. The shape of the second retention surfaces 301 may be chosen based on the shape of the portion of the container to be received by the lid 100 and/or the shape of the flanges 303. For example, the shape of the second retention surfaces 301 may be chosen based off of the curvilinear shape of a ceramic coffee mug lip. Additionally, the second retention surfaces 301 may have grooves, indentations, ditches, or recesses that can be configured to receive or engage another portion of the lid (e.g., a portion of a flange). For example, as illustrated in FIGS. 6 and 7, in an embodiment, the second retention surfaces 301 can include a groove 390 configured to slidably engage a flange 303.

As shown in FIG. 4, as the outer ring 105 moves relative to the center piece 101, towards a second position, one or more of the flanges 303 can become into contact, touch, and/or become engaged with a portion of the second retention surfaces 301. As an example, if one or more of the second retention surfaces 301 has a groove, as the outer ring 105 is rotated from the first position towards the second position, the grove of the second retention surface 301 can become slidably engaged with a portion of the flange 303. As a result of the first end 317*a* of the flange 303 extending inward to a greater degree than the second end 317*b* of the flange, the second retention surfaces 301 may be gradually pushed inward towards the inner ring 311 causing the second retention surfaces to move or deflect towards the inner ring 311. The movement of the second retention surfaces 301 towards the inner ring 311 can then reduce the width of the receiving space 315. See FIGS. 5 and 7. In an embodiment, the second retention surfaces 301 can be continually bent inwards towards the inner ring 311 as the outer ring 105 is moved from the first position to the second position.

When the outer ring 105 is in the second position, in some embodiments, the second retention surface 301 may be deflected towards the inner ring 311 such that the receiving space 315 is reduced up to about 50% compared to the width of the receiving space when the outer ring is in the first position. In an embodiment, when the outer ring 105 is in the second position, the second retention surfaces 301 may be deflected inwards towards the inner ring 311 such that the receiving space 315 is reduced up to about 20% compared to the width of the receiving space when the outer ring is in the first position. In some embodiments, when the outer ring 105 is in the second position, the second retention surfaces 301 may be moved towards the inner ring 311 such that the receiving space 315 is reduced up to about 10% compared to the width of the receiving space when the outer ring is in the first position. Moreover, when the outer ring 105 is in the second position, in some embodiments, one end of a second retention surface 301 can be approximately flush with the edge of the first end 317*a* of a flange 303. In other embodiments, when the outer ring 105 is in the second position, a portion of a second retention surface 301 may not be in contact with a flange 303.

Deflecting the second retention surfaces 301 toward the inner ring 311 when a portion of a container is received within the receiving space 315 may increase the frictional grip of the first and second retention surfaces on the received portion of the container. Stated differently, by decreasing the width of the receiving space 315 through the movement of one or more of the second retention surfaces 301 towards the inner ring 311, the contact of the inner ring and/or the contact of one or more of the retention surfaces 301 on a container can become greater. In an embodiment, when one or more of the second retention surfaces 301 are deflected towards the inner ring 311, the frictional grip of the inner ring 311 on an inner surface of a container and the frictional grip of the second retention surfaces 301 on the outer surface can be increased.

The lid 100 may further include a mechanism (not shown) for restricting the movement of the outer ring 105 past the second position. For example, the outer ring 105 may include a stop or ridge that is of sufficient shape and height such that the outer ring cannot move beyond the second position. In an embodiment, the outer ring 105 may include a protrusion extending from the inner portion of the ring towards the inner ring 311. The protrusion may contact the center piece 101 at a first point when the outer ring 105 is in the first position and may contact the center piece 101 at a second point when the outer ring is in the second position in order to restrict the movement of the outer ring 105 relative to the center piece 101 between the first position and the second position.

In other embodiments, the outer ring 105 can be moved beyond the second position and back to the first position by continuing to move the outer ring in the same direction. For example, in some embodiments, the outer ring 105 can be configured to continuously rotate in one direction between a first position and a second position and then back to a first position. In other embodiment, the outer ring 105 can be configured such that the outer ring can be moved in one direction to move from the first position to the second position and the other direction to move from the second position to the first position. As an example, the outer ring 105 can be rotated in a clockwise direction to go from the first position to the second position but a counter-clockwise direction to go from the second position to the first position.

As the outer ring 105 is moved from the second position to the first position, one or more of the second retention surfaces 301 can move away from the inner ring 311. This in turn can increase the width of the receiving space 315. In some embodiments, when the outer ring 105 is moved back to the first positions, one or more of the second retention surfaces 301 can be moved back to their initial positions. In some embodiments, as the outer ring 105 is moved from the second position to the first position, the second retention surfaces 301 can be continuously moved away from the inner ring 311. By increasing the width of the receiving space 315 as the outer ring 105 is moved from the second position to the first position, the frictional grip of the inner ring 311 on the container (such as the inner wall of the container) and/or the second retention surfaces on the container (such as the outer wall of the container) can be decreased. As a result of the frictional grip being decreased, the portion of the container within the receiving space 315 can be removed.

In an embodiment, a portion of a container (not shown) may be placed within the receiving space 315 when the outer ring 105 is in the first position. As previously stated, by moving the outer ring 105 from the first position to the second position, the frictional grip on the container increases as a result of the narrowing of the receiving space 315. The increased frictional grip can hold the container in the receiving space 315 such that it cannot be easily removed by pulling the lid 100 and/or container. By moving the outer ring 105 back to the first position the frictional grip on the portion of the container within the receiving space 315 can be decreased as a result of the second retention surfaces 301 moving away from the inner ring 311. The movement of the second retention surfaces 301 away from the inner ring 311 can increase the width of the receiving space 315 as compared to the width of the receiving space when the outer ring is in the second position. The decrease in frictional grip can allow for the container to be released using an equal amount of force as when the outer ring 105 is in the second position and the container cannot be decoupled from the lid 100. Thus, the lid 100 can be temporarily attached to a container. This ability to lock a lid 100 to a container can allow for the container to be transported by grasping the lid while minimizing the likelihood that the container will become detached from the container.

In some embodiments, a lid for a container having an inner surface, an outer surface, and a lip is disclosed. In some embodiments, the lid may include a first means for gripping the inner surface, a second means for gripping the outer surface, and a means for deflecting the second means towards the first means in order to narrow a space between the first means and the second means. In an embodiment, the first means may include an inner ring extending generally in a first direction, for example, downward, and can include a first retention surface with a first diameter. In an embodiment, the second means may include one or more second retention surfaces extending generally in the first direction, for example downward, and may be distanced from the first retention surface so as to form or define a receiving space therebetween. In an embodiment, the receiving space can have a width that is sized so as to releasably accept at least a portion of the container. In an embodiment, the one or more second retention surfaces may be disposed outside the inner ring. In some embodiments, the means for deflecting the second means may include an outer ring that is configured to move relative to the center piece between at least a first position and the second position. In an embodiment, the outer ring can have a second diameter that is greater than the first diameter. In an embodiment, the outer ring can include one or more flanges that extend generally towards the inner ring. In some embodiments, the flanges can have a first end and a second end. In an embodiment, the first end of each flange can extend towards the inner ring to a greater degree than the second end.

Turning now to FIG. 8, in some embodiments, the center piece 101 can optionally include one or more O-rings, gaskets, or seals 313. The O-rings or seals 313 can be positioned on any suitable position of the lid 100 that can facilitate the releasable seal of the lid and a portion of a container. For example, an O-ring or seal 313 may be positioned around the inner ring 311 and/or partially within the receiving space 315. The O-ring or seal 313 may have a generally curvilinear shape. For example, in an embodiment, the O-ring or seal 313 is generally circular. In another embodiment, the O-ring or seal 313 may have about the same general shape as the inner ring 311 and/or a portion of the receiving space 315. The O-ring or seal 313 may comprise any suitable material, for example, soft rubber. In some embodiments, the O-ring or seal 313 may be textured (such as including one or more ridges). For example, O-ring or seal 313 may have two ridges. In other embodiments, an O-ring or seal 313 may have a smooth surface. Methods for attaching and/or adding an O-ring, seal, or gasket 313 to the center piece 101 are known to those skilled in the art and include, for example, using an adhesive.

In some embodiments, the center piece 101 and the outer ring 105 may be separate components. In an embodiment, the lid 100 can be assembled by slipping the outer ring 105 over the top of the center piece 101. The center piece 101 may include a surface 801 upon which the outer ring 105 may engage such that the outer ring will rest on the surface. Examples of suitable surfaces 801 include but are not limited to, a lip, edge, (flat or curved), step, terrace, or ridge. The width of surface 801 is variable depending upon the size of the outer ring 105 and the size of the portion of the container to be received by the lid. In another embodiment, the center piece 101 and the outer ring 105 may be integral.

The lid 100 may also include one or more symbols (not shown) indicating a first position (for example, an open and/or unlocked position) and a second position (for example, a locked and/or closed position). Additionally, the lid 100 may also include one or more symbols, such as one more arrows, that indicate the direction that one has to move the outer ring 105 in order to move from a first position to a second position and vice-a-versa. Position of the aforementioned symbols can be positioned anywhere on the lid 100. In some embodiments, the symbols can be located on an outer surface of the lid 100. For example, the symbols can be located on the outside of the outer ring 105. As another example, the symbol(s) can be positioned on the center piece 101. In some embodiments, the outer ring 105 may include a locked padlock shaped protrusion and an unlocked padlock shaped protrusion to indicate the second position and first position, respectively.

It will be readily apparent to one skilled in the art that varying substitutions and modifications can be made to the embodiments disclosed herein without departing from the scope and spirit of the invention.

The invention illustratively described herein suitably can be practiced in the absence of any element or elements, limitation or limitations which is not specifically disclosed herein. The terms and expressions which have been employed are used as terms of description and not of limitation, and there is no intention that in the use of such terms and expressions indicates the exclusion of equivalents of the features shown and described or portions thereof. It is recognized that various modifications are possible within the scope of the invention. Thus, it should be understood that although the present invention has been specifically disclosed by certain inventive embodiments and optional features, modification and variation of the concepts herein disclosed can be resorted to by those skilled in the art, and that such modifications and variations are considered to be falling within the scope of the embodiments of the invention.

What is claimed is:

1. A lid for a container including an inner surface, an outer surface, and a lip, the lid comprising:

a center piece comprising a first retention surface extending generally in a first direction, the first retention surface having a first diameter; and one or more second retention surfaces extending generally in the first direction, each second retention surface comprising a groove, wherein the one or more second retention surfaces are distanced from the first retention surface so as to define a receiving space therebetween, wherein the receiving space has a width that is sized so as to releasably accept at least a portion of the container, and wherein the one or more second retention surfaces are disposed outside the first retention surface; and an outer ring that is rotatable relative to the center piece between at least a first position and a second position, the outer ring having a second diameter that is greater than the first diameter, and wherein the outer ring comprises one or more flanges;

wherein each flange extends generally towards the first retention surface and slidably engages at least one second retention surface at least when the outer ring is rotated between the first position and the second position, and wherein the flanges have a first end and second end, wherein the first end of each flange extends towards the first retention surface to a greater degree than the second end of each flange.

2. The lid of claim 1, wherein the center piece comprises a plurality of second retention surfaces situated in a generally curvilinear shape having a third diameter, wherein the third diameter is greater than the first diameter, and wherein the third diameter is less than the second diameter.

3. The lid of claim 1, wherein when the outer ring is in the second position, the width of the receiving space is less than the width of the receiving space when the outer ring is in the first position.

4. The lid of claim 1, wherein the width of the receiving space decreases as the outer ring rotates from the first position to the second position.

5. The lid of claim 1, wherein the second retention surface comprises a plurality of second retention surfaces, and the second retention surfaces are substantially evenly spaced from one another.

6. The lid of claim 1, wherein the center piece further comprises a first aperture.

7. The lid of claim 1, wherein the center piece further comprises a second aperture.

8. The lid of claim 1, wherein the outer ring comprises a plurality of flanges, and the flanges are substantially evenly spaced from one another.

9. The lid of claim 1, wherein the number of second retention surfaces is equal to the number of flanges.

10. The lid of claim 1, wherein at least one of the one or more second retention surfaces is a downward extending tab.

11. The lid of claim 1, further comprising an O-ring disposed at least partially on the first retention surface.

12. A lid for a beverage container including an inner surface, an outer surface, and a rim, the lid comprising:

a center piece comprising a first retention surface extending generally in a first direction, the first retention surface having a first diameter; and one or more second retention surfaces extending generally in the first direction, each second retention surface comprising a groove, wherein the one or more second retention surfaces are positioned relative to the first retention surface so as to define a receiving space therebetween, and wherein the one or more second retention surfaces are disposed outside the first retention surface;

an outer ring that is rotatable relative to the center piece between at least a first position and a second position, the outer ring having a second diameter that is greater than the first diameter, and wherein the outer ring comprises one or more flanges;

wherein the one or more flanges extend generally towards the first retention surface, and wherein the flanges have a first end and second end, wherein the first end of each flange extends towards the first retention surface to a greater degree than the second end of each flange, wherein at least one flange slidably engages the groove of at least one second retention surface at least when the outer ring is rotated between the first position and the second position such that the at least one second retention surface is deflected toward the first retention surface.

13. The lid of claim 12, wherein in the first position, at least a portion of the one or more second retention surfaces are not engaged with at least a portion of the one or more flanges.

14. The lid of claim 12, wherein in the first position, at least a portion of the one or more second retention surfaces are engaged with at least a portion of the one or more flanges.

15. The lid of claim 12, wherein in the second position, at least a portion of the one or more second retention surfaces are engaged with at least a portion of one or more flanges.

16. The lid of claim 15, wherein in the second position the width of the receiving space is less than when the outer ring is in the first position.

17. The lid of claim 12, wherein in the second position, at least a portion of at least one second retention surface is engaged with at least a portion of the first end of one or more flanges.

18. The lid of claim 12, wherein in the first position, at least a portion of one second retention surface overlaps at least a portion of the second end of one or more flanges.

19. The lid of claim 12, wherein in the first position, at least a portion of at least one second retention surface does not overlap at least a portion of one or more flanges.

20. The lid of claim 12, wherein as the outer ring is moved between the first position and the second position, at least a portion of at least one second retention surface engages at least a portion of a flange , and the second retention surface is moved towards the center piece.

21. The lid of claim 12, wherein when the outer ring is in the second position, at least a portion of at least one second retention surface overlaps at least a portion of a flange.

22. A lid and container kit, comprising:

a container comprising an inner surface, an outer surface, and a rim; and a lid for the container comprising a center piece comprising a first retention surface extending generally in a first direction, the first retention surface having a first diameter, wherein the first retention surface is configured to contact at least a portion of the inner surface;

one or more second retention surfaces extending generally in the first direction, each second retention surface comprising a groove, wherein the one or more second retention surfaces are distanced from the first retention surface so as to define a receiving space therebetween, wherein the receiving space has a width that is sized so as to releasably accept at least a portion of the rim, wherein the one or more second retention surfaces are disposed outside the first retention surface and wherein the one or more second retention surfaces are configured to contact at least a portion of the outer surface; and an outer ring that is rotatable relative to the center piece between at least a first position and a second position, the outer ring having a second diameter that is greater than the first diameter, and wherein the outer ring comprises one or more flanges;

wherein each flange extends generally towards the first retention surface and slidably engages at least one second retention surface at least when the outer ring is rotated between the first position and the second position, and wherein the flanges have a first end and second end, wherein the first end of each flange extends towards the first retention surface to a greater degree than the second end of each flange.

* * * * *